US008683722B1

(12) United States Patent
Cowan

(10) Patent No.: US 8,683,722 B1
(45) Date of Patent: Apr. 1, 2014

(54) ULTRA-VIOLET SELECTIVE VEHICLE DECORATION

(71) Applicant: Toyota Motor Engineering & Manufacturing North America, Inc., Erlanger, KY (US)

(72) Inventor: Paul D. Cowan, Pinckney, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 13/654,153

(22) Filed: Oct. 17, 2012

(51) Int. Cl.
*G09F 13/00* (2006.01)

(52) U.S. Cl.
USPC ..... 40/543; 40/559; 40/591

(58) Field of Classification Search
USPC ..... 40/543, 559, 591
See application file for complete search history.

(56) References Cited

U.S. PATENT DOCUMENTS 2,430,232 A * 11/1947 Lynch ..... 40/543
2,652,650 A * 9/1953 Helms et al. ..... 40/591
3,263,358 A 8/1966 Dosie et al.
5,893,226 A * 4/1999 Sophocleous et al. ..... 40/591
5,997,161 A 12/1999 Stringfellow et al.
7,418,726 B2 * 8/2008 Fuwausa ..... 720/718
7,575,349 B2 * 8/2009 Bucher et al. ..... 362/503
2004/0189483 A1 9/2004 Stringfellow
2005/0108910 A1 * 5/2005 Esparza et al. ..... 40/600
2006/0260162 A1 * 11/2006 Ballinger ..... 40/591

* cited by examiner

*Primary Examiner* — Gary Hoge
(74) *Attorney, Agent, or Firm* — Christopher G. Darrow; Young Basile Hanlon & MacFarlane, P.C.

(57) ABSTRACT

An apparatus and method for selectively decorating a vehicle surface are disclosed. The apparatus is a removable applique with a front face including a graphic comprising ultra-violet responsive material and a back face including an attachment agent having the ability to be applied and removed from the surface of the vehicle without causing damage. The method includes receiving the removable applique on the surface of a vehicle. The method further includes sending an instruction to illuminate an ultra-violet source to direct ultra-violet light at the graphic of the removable applique to render the graphic visible. In one embodiment, the instruction to illuminate the ultra-violet source can be sent in response to the activation of a switch, button, control panel or other input means of controlling the ultra-violet source. In another embodiment, the instruction to illuminate the ultra-violet source can be sent in response to a vehicle state.

18 Claims, 4 Drawing Sheets

ULTRA-VIOLET SELECTIVE VEHICLE DECORATION

BACKGROUND

Motor vehicles can be decorated with a variety of graphical appliques. For example, vehicle operators or passengers can indicate an affinity for a sports team, show caricatures of their family members, or exhibit social commentary in the form of bumper stickers including textual statements.

SUMMARY

An apparatus and methods for selectively decorating and animating the surface of a vehicle are disclosed.

One aspect of the disclosed embodiments is a removable applique for selectively decorating a surface of a vehicle. The removable applique comprises a material including a front face and a back face and having a shape capable of contouring to the surface of the vehicle. The front face of the material includes a graphic comprising ultra-violet responsive material and the back face of the material includes an attachment agent having the ability to be applied and removed from the surface of the vehicle without causing damage to the surface of the vehicle.

Another aspect of the disclosed embodiments is a selectively decorated vehicle. The vehicle includes a vehicle surface and a removable applique applied to the vehicle surface. The removable applique includes a graphic comprising ultra-violet responsive material. The vehicle further includes an ultra-violet source for directing ultra-violet light at the graphic to render the graphic visible and means for sending an instruction to illuminate the ultra-violet source.

Another aspect of the disclosed embodiments is a method of selectively decorating a surface of a vehicle. The method includes receiving a removable applique on the surface of the vehicle. The removable applique includes one or more graphics comprising ultra-violet responsive material. The method further includes sending an instruction to illuminate an ultra-violet source to direct ultra-violet light at the one or more graphics to render the one or more graphics visible.

BRIEF DESCRIPTION OF THE DRAWINGS

The description herein makes reference to the accompanying drawings wherein like reference numerals refer to like parts throughout the several views, and wherein.

DETAILED DESCRIPTION

Operators and passengers in motor vehicles often desire decorations to be placed on both the interior and exterior of the vehicle. Existing methods of decorating the surface of a vehicle are inflexible in that the decoration is always visible, which may not be desirable for a given vehicle operator or passenger. For example, a vehicle operator may wish to highlight a sports-based graphic on the exterior of their vehicle while driving to and from a game, but may not wish to highlight the same graphic while commuting to and from work. As another example, a child passenger may wish to apply cartoon-style graphics to vehicle trim panels while riding in the vehicle while her parent, the vehicle operator, wishes to easily hide the graphics when transporting other adults. An apparatus and methods for selectively decorating and animating the surface of a vehicle using ultra-violet light sources and ultra-violet responsive graphics are disclosed herein.

Figure 1A:
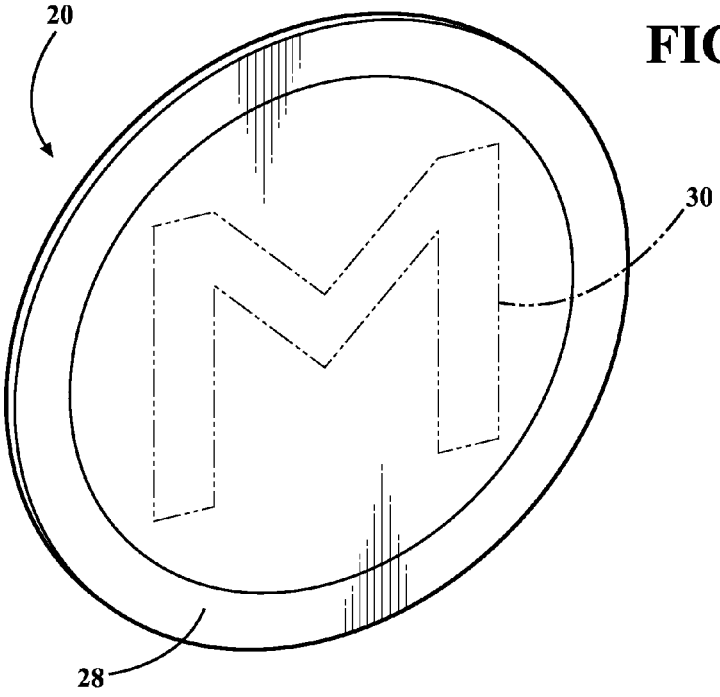
FIGS. 1A-1C are a schematic front perspective view, side perspective view, and rear perspective view of a removable applique apparatus.
Figure 1B:
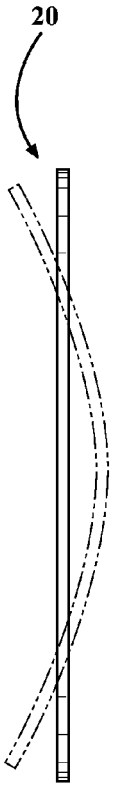
Figure 1C:
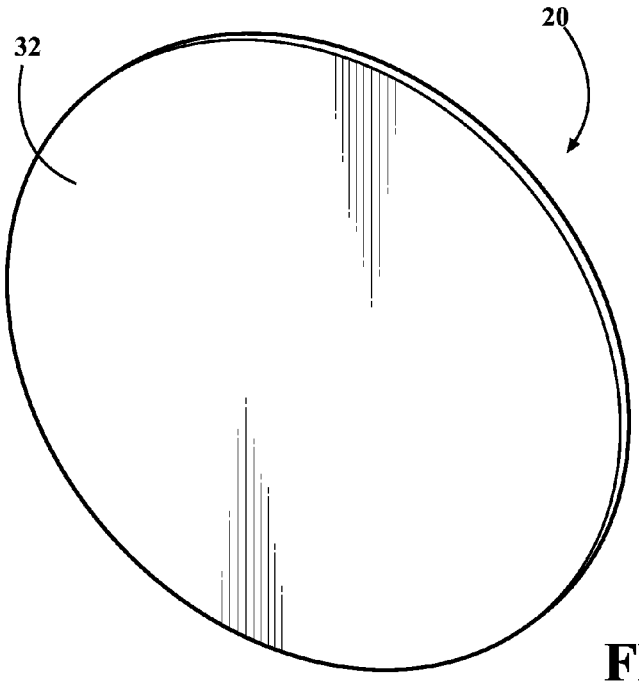

FIGS. 1A-1C are schematics of a removable applique (20) in accordance with one embodiment. The schematics include a front perspective view in FIG. 1A, a side perspective view in FIG. 1B, and rear perspective view in FIG. 1C. The front perspective view in FIG. 1A shows that the applique (20) includes a front face (28). The front face (28) includes a graphic (30) comprised of ultra-violet responsive material. The graphic (30) can be designed to take many different shapes. For example, the graphic (30) can display characters or shapes symbolizing a sports team, a phrase or saying, a grouping of people, or any other decorative representation of interest to the party, e.g. the vehicle operator or passenger, using the removable applique (20).

The side perspective view in FIG. 1B shows that the applique (20) has a flexible shape capable of contouring to the surface of the vehicle. The applique (20) can be designed for flexing, bending, and easy pressing and smoothing as needed to minimize wrinkles that would appear on the front face (28) when the applique (20) adheres to the surface of the vehicle.

The rear perspective view of FIG. 1C shows that the applique (20) includes a back face (32). The back face (32) includes an attachment agent (not shown) allowing the removable applique (20) to be applied and removed from the surface of a vehicle without causing damage to the surface of the vehicle. The attachment agent can be, for example, a magnetic surface for adhering to a metallic surface of a vehicle. The attachment agent can also be, for example, a statically-charged film for adhering to any flat surface of a vehicle.

The applique (20) can also be adhered to a surface of a vehicle in the form of temporary or removable ultra-violet responsive ink or paint applied directly to the vehicle using a stencil or free-hand design. In this example, the attachment agent and graphic (30) are integral. The attachment agent can also be any other means of attaching the applique (20) to the surface of a vehicle.

Figure 2A:
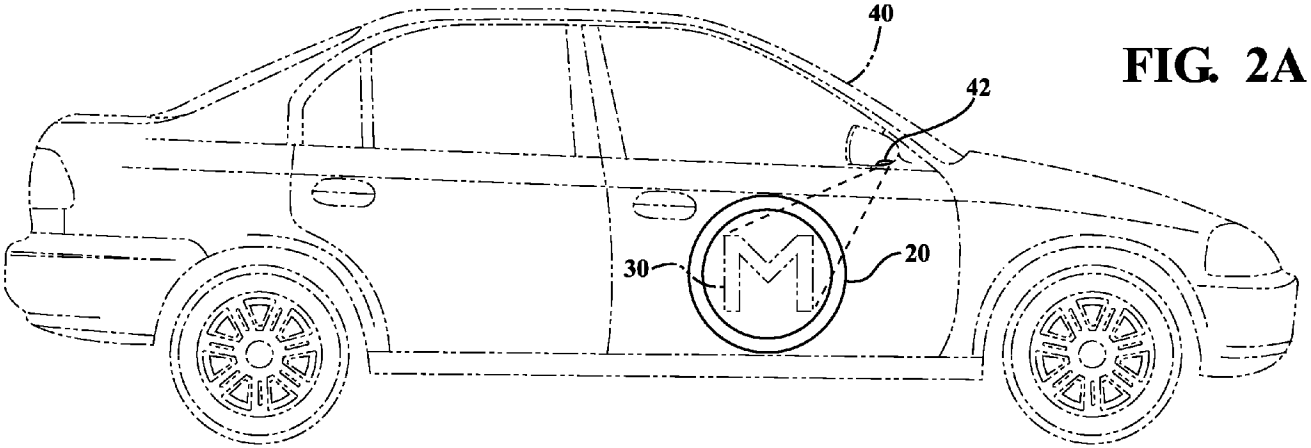
FIGS. 2A-2B are schematic illustrations of example methods of selectively decorating the surface of a vehicle with example removable appliques.
Figure 2B:
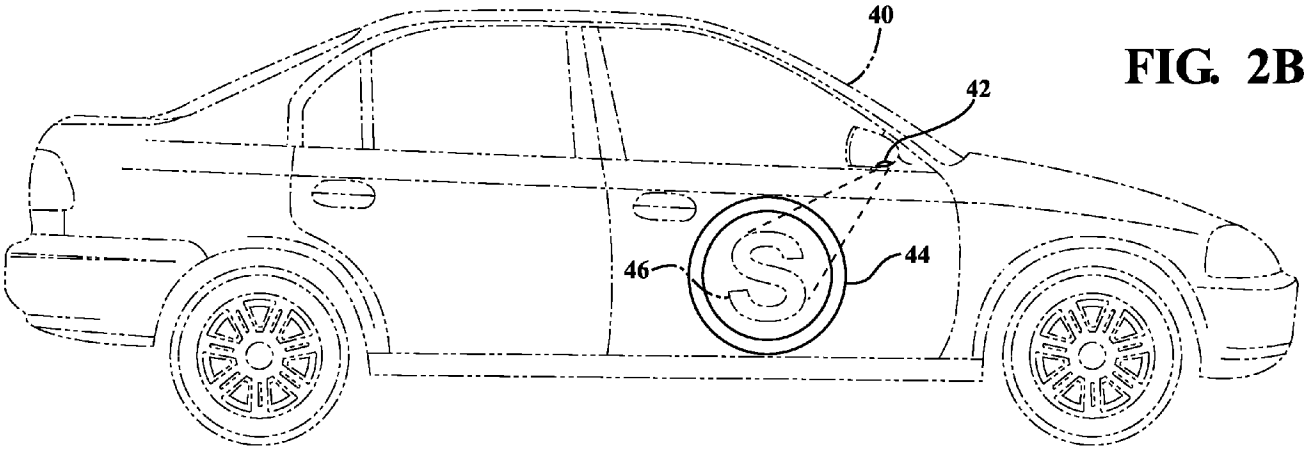

FIGS. 2A-2B are schematic illustrations of example methods of selectively decorating the surface of a vehicle (40). One example method shown in FIG. 2A includes receiving the removable applique (20) shown in FIGS. 1A-1C on the surface of the vehicle (40). As described in FIGS. 1A-1C, the removable applique (20) includes a graphic (30) comprising ultra-violet responsive material. The ultra-violet responsive material would not be visible in natural light. This example method further includes sending an instruction to illuminate an ultra-violet source (42) to direct ultra-violet light at the graphic (30) to render the graphic (30) visible. Without the ultra-violet light, the graphic (30) remains largely invisible. This method has the advantage of allowing the vehicle operator or passenger control over the use of decoration on the surface of the vehicle (40).

Another example method shown in FIG. 2B includes removing the first removable applique (20) and receiving a second removable applique (44) on the surface of the vehicle (40). The second removable applique (44) includes a second graphic (46) comprising ultra-violet responsive material. This example method further includes sending an instruction to illuminate the ultra-violet source (42) to direct ultra-violet light at the second graphic (46) to render the second graphic (46) visible. The first removable applique (20) and the second removable applique (44) are interchangeable, allowing the party using the appliques (20, 44) to change the graphic (30, 46) displayed on the surface of the vehicle (40) as desired.

In the examples described in FIGS. 2A-2B, the surface of the vehicle (40) is an exterior surface, for example, a door exterior surface. The ultra-violet source (42) can be positioned adjacent to the exterior surface, for example, on a side minor of the vehicle (40) adjacent to the door exterior surface. The instruction to illuminate the ultra-violet source (42) can occur in response to the activation of a switch or other means of controlling the ultra-violet source (42). For example, the party using the appliques (20, 44) can also operate the vehicle (40). The party can select, toggle, or otherwise engage a switch, button, control panel, or any other input means inside or outside the vehicle (40) capable of activating the ultra-violet source (42). As another example, the instruction to illuminate the ultra-violet source (42) can occur in response to the activation of a vehicle blinker, brake pedal, or parking brake.

Figure 3:
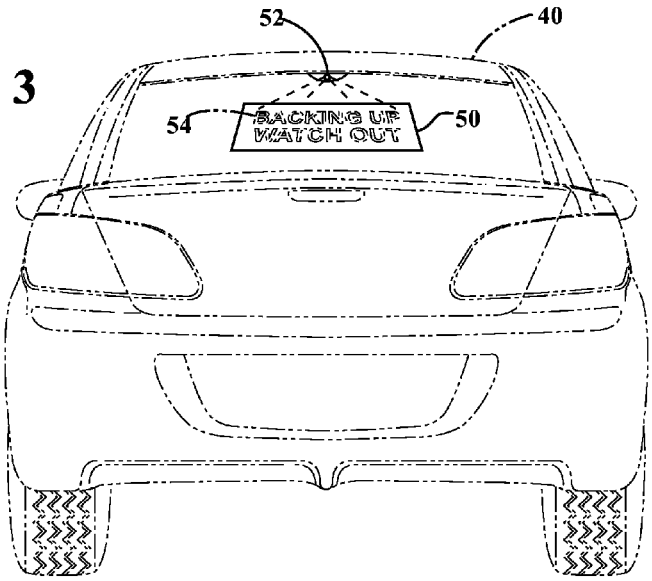
FIG. 3 is a schematic illustration of an example method of selectively decorating the surface of a vehicle with an example removable applique.

FIG. 3 is a schematic illustration of another example method of selectively decorating the surface of a vehicle (40) with a removable applique (50). In this example, the exterior surface of the vehicle (40) is a backlight, and the ultra-violet source (52) is positioned on a brake lamp of the vehicle (40) adjacent to the backlight. The instruction to illuminate the ultra-violet source (52) can be sent in response to the vehicle (40) shifting into reverse, and the ultra-violet responsive material of the graphic (54) can include a textual warning. For example, the textual warning "Backing Up, Watch Out" can appear when the vehicle (40) shifts into reverse.

As another example, the instruction to illuminate the ultra-violet source (52) can be sent in response to the vehicle (40) receiving a command from a remote keyless entry device or similar device. In this example, the ultra-violet responsive material of the graphic (54) can include text or other features helping to identify the vehicle (40) and the ultra-violet source (52) can be positioned in a brake lamp or license plate fixture. Additional surfaces and use of text are possible; the reverse brake lamp or license plate fixture illumination of a textual warning or indicator are just examples.

Figure 4:
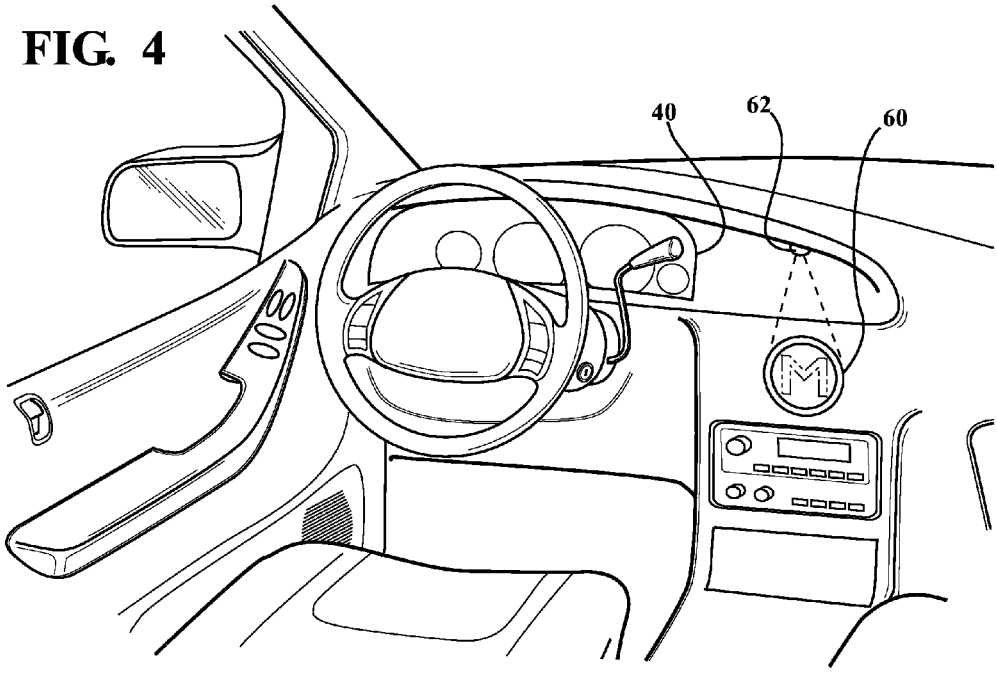
FIG. 4 is a schematic illustration of an example method of selectively decorating the surface of a vehicle with an example removable applique.

FIG. 4 is a schematic illustration of another example method of selectively decorating the surface of a vehicle (40) with a removable applique (60). In this example, the surface of the vehicle (40) is an interior surface, for example, part of an instrument panel. The ultra-violet source (62) can be positioned on an interior trim panel adjacent to the interior surface. The instruction to illuminate the ultra-violet source (62) can be sent in response to the activation of a switch or other means of controlling the ultra-violet source (62). For example, the party operating the vehicle (40) can select, toggle, or otherwise engage a switch, button, control panel, or any other input means inside or outside the vehicle (40) capable of activating the ultra-violet source (62). In one embodiment, the vehicle (40) can be designed such that the ultra-violet source (62) is activated when the volume of the audio system is increased to a certain level. In another embodiment, the vehicle (40) can be designed such that the ultra-violet source (62) is activated when a driver or passenger engages a vehicle blinker, accelerator, brake pedal, or parking brake.

Figure 5A:
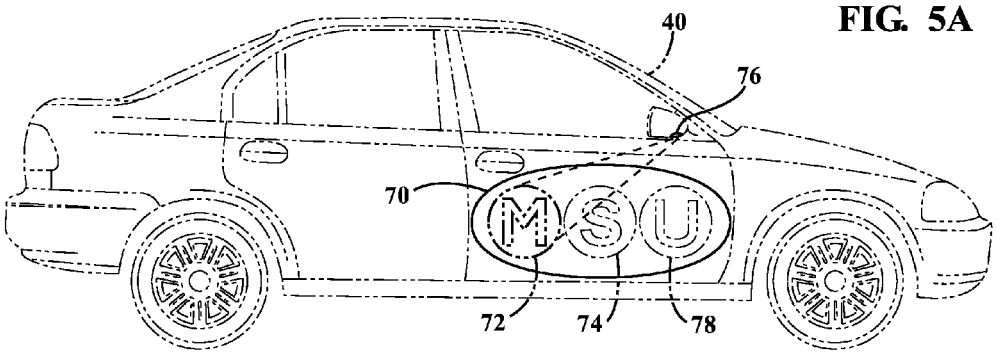
FIGS. 5A-5C are schematic illustrations of a method of selectively animating a series of graphics on the surface of a vehicle.
Figure 5B:
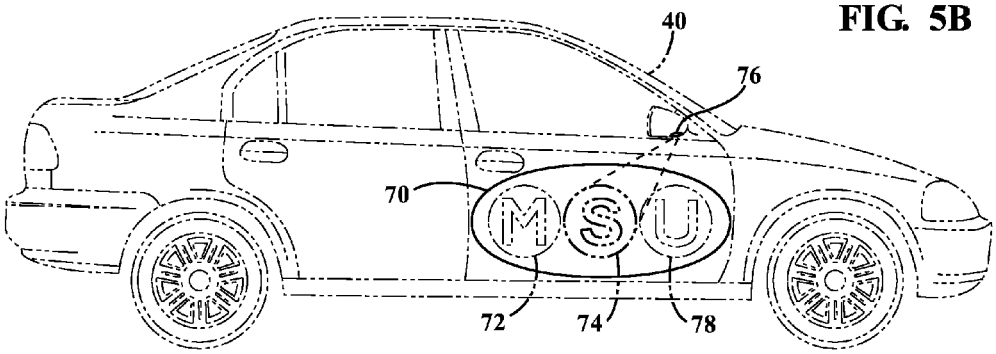
Figure 5C:
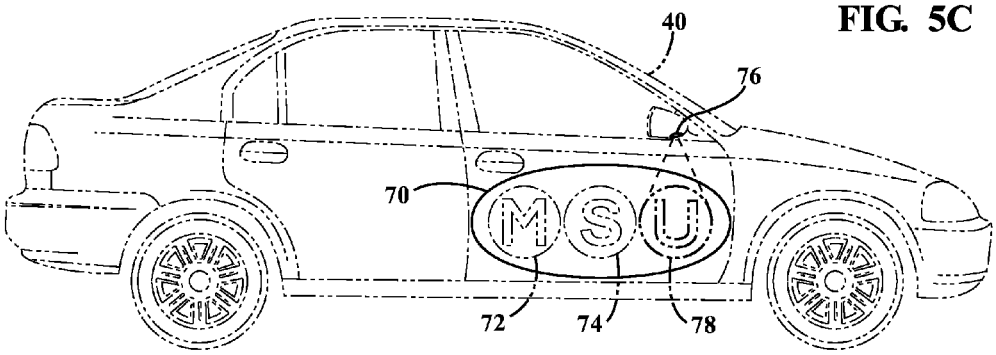

FIGS. 5A-5C are schematic illustrations of a method of selectively animating a series of graphics on the surface of a vehicle (40). The method includes receiving one or more removable appliques (70) on the surface of a vehicle (40) as in shown in each of FIGS. 5A-5C. The one or more appliques (70) include at least a first graphic (72) comprising ultra-violet responsive material and a second graphic (74) comprising ultra-violet responsive material, with the second graphic (74) positioned adjacent to the first graphic (72).

The method of animation includes sending an instruction to illuminate an ultra-violet source (76) to direct ultra-violet light at the first graphic (72) to render the first graphic (72) visible as shown in FIG. 5A. The animation continues by sending an instruction to illuminate the ultra-violet source (76) to direct ultra-violet light at the second graphic (74) to render the second graphic (74) visible as shown in FIG. 5B. The applique (70) can also include additional graphics, such as third graphic (78), as part of the customized animation, with the animation completed in this example by sending an instruction to illuminate the ultra-violet source (76) to direct ultra-violet light at the third graphic (78) to render the third graphic (78) visible as shown in FIG. 5C.

In the method shown in FIGS. 5A-5C, the surface of the vehicle (40) is a door exterior surface, but the surface can be any other surface of the vehicle (40), interior or exterior, such as those surfaces shown in FIGS. 3 and 4. The ultra-violet source (76) can be a singular source, for example, housed in the side mirror of a vehicle (40) as shown in FIGS. 5A-5C, or a plurality of sources depending on the location of the graphics (72, 74, 78). The method can further include sending an instruction to stop illuminating the ultra-violet source (76) directing ultra-violet light at the first graphic (72) before sending the instruction to direct ultra-violet light at the second graphic (74), thus creating an animation sequence effect for the viewer of the graphics (72, 74). Additional graphics, such as third graphic (78), can also be part of the animation sequence effect.

In the method described in FIGS. 5A-5C, the instruction to illuminate the ultra-violet source (76) can occur in response to the activation of a switch or other means of controlling the ultra-violet source (76). For example, a party operating the vehicle (40) can select, toggle, or otherwise engage a switch, button, control panel, pedal, parking brake, remote device or other input means inside or outside the vehicle (40) capable of activating the ultra-violet source (76). Once activated, the ultra-violet source (76) can implement a pattern of directing the ultra-violet light, illuminating the first graphic (72), then second graphic (74), then third graphic (78) in sequence, including repetition of the sequence to create the animation sequence effect.

The foregoing description relates to what are presently considered to be the most practical embodiments. It is to be understood, however, that the disclosure is not to be limited to these embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A selectively decorated vehicle, comprising:

a vehicle surface;

a removable applique applied to the vehicle surface, the removable applique including a graphic comprising ultra-violet responsive material;

an ultra-violet source for directing ultra-violet light at the graphic to render the graphic visible; and means for sending an instruction to illuminate the ultra-violet source based on the level of the volume of an audio system in the vehicle.

2. The vehicle of claim 1 wherein:

the vehicle surface is an exterior surface; and the ultra-violet source is positioned adjacent to the exterior surface.

3. The vehicle of claim 1 wherein:

the vehicle surface is an interior surface; and the ultra-violet source is positioned on an interior trim panel adjacent to the interior surface.

4. The vehicle of claim 1 wherein the removable applique includes:

a front face including the graphic comprising ultra-violet responsive material; and a back face including an attachment agent having the ability to be applied and removed from the surface of the vehicle without causing damage to the surface of the vehicle.

5. The vehicle of claim 4 wherein the attachment agent is magnetic.

6. The vehicle of claim 4 wherein the attachment agent is statically charged.

7. A selectively decorated vehicle, comprising:

a vehicle surface;

a removable applique applied to the vehicle surface, the removable applique including a graphic comprising ultra-violet responsive material;

an ultra-violet source for directing ultra-violet light at the graphic to render the graphic visible positioned adjacent to the vehicle surface; and means for sending an instruction to illuminate the ultra-violet source based on shifting the vehicle into reverse.

8. The vehicle of claim 7 wherein:

the exterior surface is a backlight;

the ultra-violet source is positioned on a brake lamp of the vehicle adjacent to the backlight; and the ultra-violet responsive material of the graphic includes a textual warning.

9. The vehicle of claim 7 wherein the removable applique includes:

a front face including the graphic comprising ultra-violet responsive material; and a back face including an attachment agent having the ability to be applied and removed from the surface of the vehicle without causing damage to the surface of the vehicle.

10. The vehicle of claim 9 wherein the attachment agent is magnetic.

11. The vehicle of claim 9 wherein the attachment agent is statically charged.

12. A method of selectively decorating a surface of a vehicle comprising:

receiving a removable applique on the surface of the vehicle, the removable applique comprising ultra-violet responsive material and including at least two graphics with a first graphic positioned adjacent a second graphic;

sending an instruction to illuminate an ultra-violet source to direct ultra-violet light at the first graphic to render the first graphic visible;

sending an instruction to stop illuminating the ultra-violet source directing ultra-violet light at the first graphic; and sending an instruction to illuminate the ultra-violet source to direct ultra-violet light at the second graphic to render the second graphic visible.

13. The method of claim 12 wherein:

the surface of the vehicle is an exterior surface; and the ultra-violet source is positioned adjacent to the exterior surface.

14. The method of claim 13 wherein:

the exterior surface is a door exterior surface;

the ultra-violet source is positioned on a side mirror of the vehicle adjacent to the door exterior surface; and the sending of the instruction to illuminate the ultra-violet source to direct ultra-violet light at the one or more graphics is in response to the activation of a switch.

15. The method of claim 12 wherein:

the surface of the vehicle is an interior surface;

the ultra-violet source is positioned on an interior trim panel adjacent to the interior surface; and the sending of the instruction to illuminate the ultra-violet source to direct ultra-violet light at the at least two graphics is in response to the volume level in an audio system of the vehicle reaching a given threshold.

16. The method of claim 12 wherein the removable applique includes:

a front face including the at least two graphics, each graphic comprising ultra-violet responsive material; and a back face including an attachment agent having the ability to be applied and removed from the surface of the vehicle without causing damage to the surface of the vehicle.

17. The method of claim 16 wherein the attachment agent is magnetic.

18. The method of claim 16 wherein the attachment agent is statically charged.

* * * * *

UNITED STATES PATENT AND TRADEMARK OFFICE

CERTIFICATE OF CORRECTION

PATENT NO. : 8,683,722 B1
APPLICATION NO. : 13/654153
DATED : April 1, 2014
INVENTOR(S) : Paul D. Cowan It is certified that error appears in the above-identified patent and that said Letters Patent is hereby corrected as shown below:

In the Specification

In column 3, line 15, please change “minor” to --mirror--.

Signed and Sealed this
Fifteenth Day of July, 2014

Michelle K. Lee

Michelle K. Lee
*Deputy Director of the United States Patent and Trademark Office*